US010350654B2

(12) United States Patent
Cook

(10) Patent No.: US 10,350,654 B2
(45) Date of Patent: Jul. 16, 2019

(54) PIPE THREAD CLEANER

(71) Applicant: Jack Cook, Heber Springs, AR (US)

(72) Inventor: Jack Cook, Heber Springs, AR (US)

( * ) Notice: Subject to any disclaimer, the term of this patent is extended or adjusted under 35 U.S.C. 154(b) by 486 days.

(21) Appl. No.: 14/568,868

(22) Filed: Dec. 12, 2014

(65) Prior Publication Data

US 2016/0167093 A1 Jun. 16, 2016

(51) Int. Cl.

| | |
|---|---|
| ***B05B 3/06*** | (2006.01) |
| ***B08B 9/02*** | (2006.01) |
| ***B05B 13/04*** | (2006.01) |
| ***B05B 13/06*** | (2006.01) |
| ***B08B 9/032*** | (2006.01) |
| ***E21B 17/00*** | (2006.01) |

(52) U.S. Cl.

CPC ..... *B08B 9/021* (2013.01); *B05B 3/06* (2013.01); *B05B 13/0421* (2013.01); *B05B 13/0636* (2013.01); *E21B 17/006* (2013.01); *B05B 13/0436* (2013.01); *B08B 9/0321* (2013.01)

(58) Field of Classification Search

CPC ..... B08B 9/027; B08B 9/032; B08B 9/0321; B08B 2209/032; B08B 2209/055; B08B 9/021; B05B 3/06; B05B 13/0421; B05B 13/0436; B05B 13/0636

See application file for complete search history.

(56) References Cited

U.S. PATENT DOCUMENTS

| | | | | |
|---|---|---|---|---|
| 2,827,009 | A * | 3/1958 | Norris | B05B 13/0636 118/301 |
| 4,403,363 | A * | 9/1983 | Hess | B08B 9/021 15/104.04 |
| 5,372,154 | A * | 12/1994 | Bee | B08B 9/021 134/110 |
| 2007/0079472 | A1 * | 4/2007 | Carter | A47L 11/00 15/345 |
| 2015/0335143 | A1 * | 11/2015 | Edmond | B08B 9/027 15/88 |

* cited by examiner

*Primary Examiner* — Mikhail Kornakov
*Assistant Examiner* — Natasha N Campbell
(74) *Attorney, Agent, or Firm* — David Gershner

(57) ABSTRACT

A pipe thread cleaning device which cleans with pressurized water. The device contains a rigid outer shell and a cleaning assembly which is inserted into the outer shell to form an enclosure and includes a water input and rotatable spray nozzles to clean threaded pipe which is inserted into the device by rotatably applying a pressurized stream of water to the pipe threads.

17 Claims, 8 Drawing Sheets

PIPE THREAD CLEANER

BACKGROUND OF THE INVENTION

The present invention is in the technical field of oil and gas pipe and casing thread cleaners. More particularly, the present invention is in the technical field of oil and gas pipe and casing thread cleaners using pressurized water.

Conventional oil and gas pipe and casing thread cleaning procedures are performed with pressure washers or powered brushes and solvents. While these methods gave acceptable results, each system has the drawbacks of excessive cost, water waste and the presence of toxic solvents.

SUMMARY OF THE INVENTION

The present invention is a pipe thread cleaner which contains the threaded end of the pipe in an enclosed box whereby the threads are cleaned by a rotating nozzle which sprays the threads with a stream of heated and pressurized water. The rotating nozzle uses multiple valve jets which rotate in a circular manner and whose movement it powered by the water pressure.

The advantages of the present invention include, without limitation, that it is relatively simple in mechanical operation, it operates without the use of hazardous solvents, it uses substantially less water than conventional methods, is substantially safer that conventional methods, and requires less time than conventional methods. The use of heated, pressurized water in an enclosed box provides superior results to conventional methods while containing all water and material removed from the pipe threads, while cleaning the pipe threads faster that non contained methods and shielding the worker from the high pressure water stream.

BRIEF DESCRIPTION OF THE DRAWINGS

These and other features, aspects, and advantages of the present invention will become better understood with regard to the following description, claims, and accompanying drawings where:

DETAILED DESCRIPTION OF THE INVENTION

Figure 1:
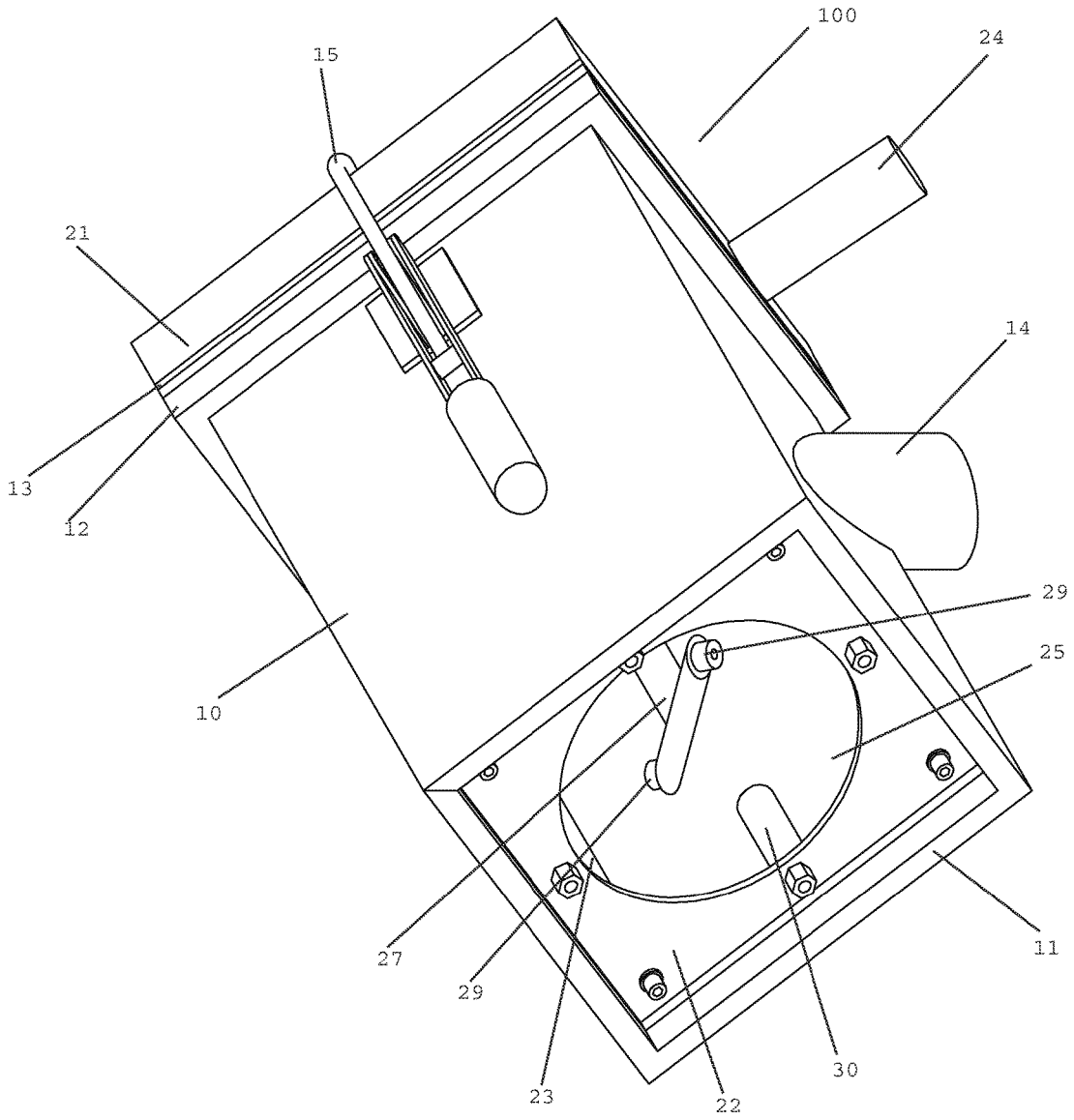
FIG. 1 is a perspective view of a first embodiment of a pipe thread cleaner of the present invention.
Figure 2:
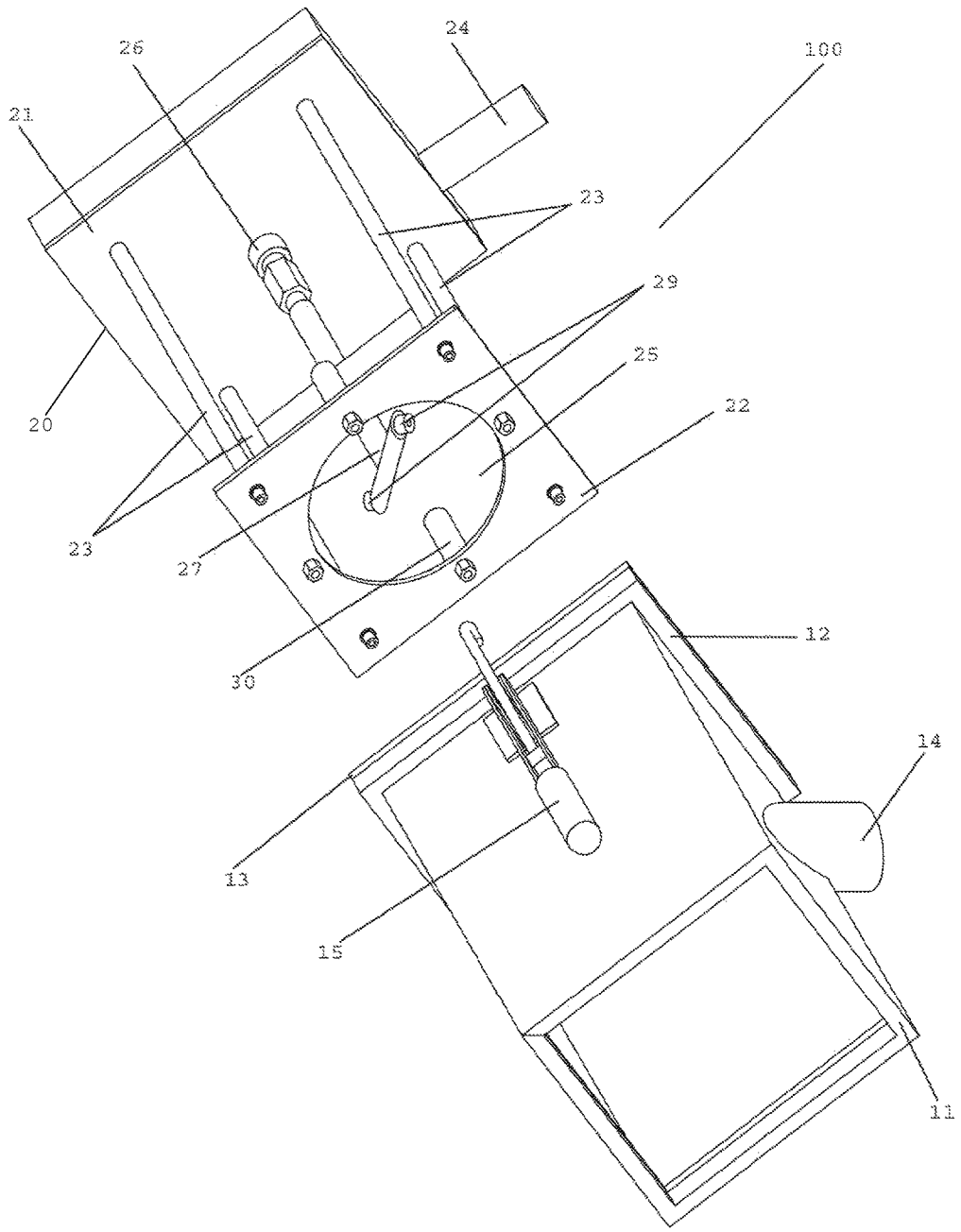
FIG. 2 is a perspective view a first embodiment of a pipe thread cleaner with the outer shell removed from the device.

Referring to the drawings, FIGS. 1 and 2 depict a first embodiment of a pipe thread cleaner 100 having an outer shell 10 with an inner flange 11, outer flange 12, drain port 14, and latches 15; and a cleaning assembly 20 with a bulkhead 21, end plate 22, support rods 23, support handle 24, pipe input port 25, water input 26, internal spray nozzle 27, spray jets 29, and guideposts 30.

The pipe thread cleaner 100 has an outer shell 10 which is open at both ends and has a polygonal or circular shape, preferable square. The shell may be constructed of any rigid material with preference to stainless steel. Further the outer shell 10 will preferably have its closed sides axially parallel to one another so that the cross section remains the same throughout the length of the shell. The shell 10 has an inner flange 11 on the second end which protrudes slightly inward. The shell 10 also has an outer flange 12 on the first end which protrudes slightly outward and may serve as a mating surface for a gasket 13. Additionally the shell 10 may have a drain port 14. Finally the shell 10 may have multiple attachment features 15. The attachment features may be latches, screws, bolts, pins or other commonly used fasteners.

The pipe thread cleaner 100 also has a cleaning assembly 20 which has a bulkhead 21 and an endplate 22 which are connected by a plurality of support rods 23 which are fastened to the bulkhead 21 and the endplate 22. The endplate 22 shall be shaped the same as the outer shell 10 and shall be dimensioned such that it is very slightly smaller than the inside dimensions of the shell 10 such that it may be inserted into the shell and mate with the inner flange 11. The bulkhead 21 shall be shaped the same as the outer shell 10 and shall be dimensioned such that it is very the same dimension as the outer flange 12. The support rods shall be dimensioned such that, when the end plate 22 is mated with the internal flange 11, the bulkhead mates with the outer flange 12 and may provide a mating surface for a gasket 13. The bulkhead 21, end plate 22, and support rods 23 may be constructed of any rigid material with preference to stainless steel. The end plate may also feature a plurality of attached guideposts 30 which prevent shifting of an inserted pipe. The bulkhead may also have a support handle 24 affixed to a side of the bulkhead 21, with the handle 24 preferably having a generally cylindrical shape and sized to be gripped by the average adult human hand. The end plate further has a pipe input port 25, preferably circular, dimensioned between two and twenty inches for insertion of pipe to be cleaned into the pipe thread cleaner 100.

Figure 4A:
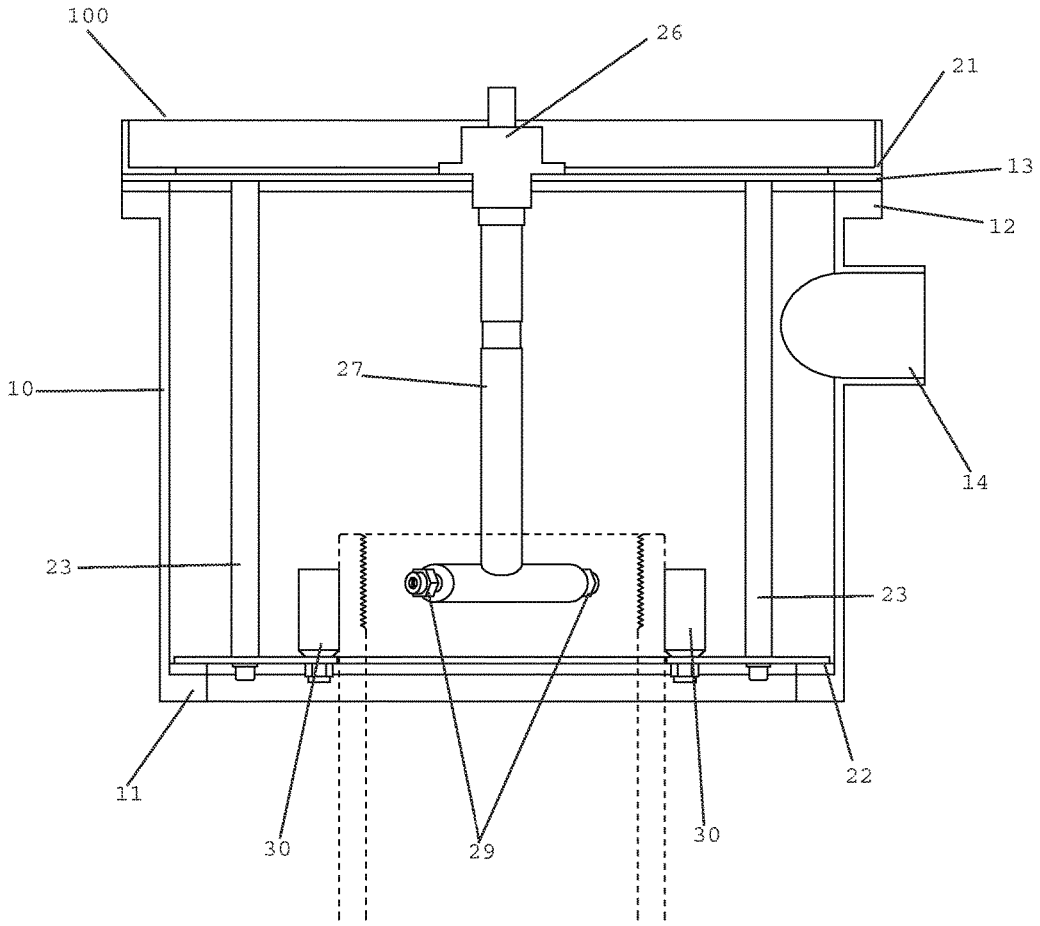
FIG. 4A is a cutaway view of a first embodiment of a pipe thread cleaner showing the placement of an inserted pipe.
Figure 4B:
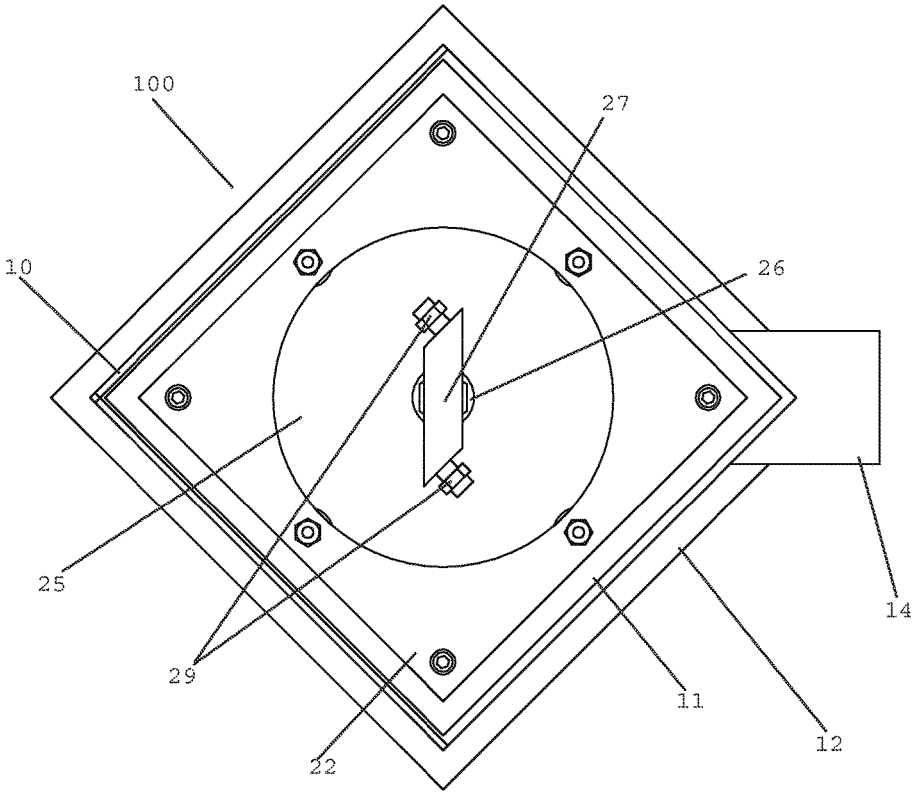
FIG. 4B is an end view of a first embodiment of a pipe thread cleaner.

Referring to the drawings, FIGS. 4A and 4B depict the water input 26, internal spray nozzle 27, and spray jets 29. The cleaning assembly also features a water input 26 which is attached to the bulkhead 21. Attached to the water input is an internal spray nozzle 27. The internal spray nozzle 27 is configured to provide a plurality of spray jets 29 which spray water in a direction radially outward from the axis of the internal spray nozzle 27. The preferred configuration of the internal spray nozzle 27 is a T configuration with two spray jets 29 oriented 180 degrees from one another. The spray jets 29 are attached to the ends of the internal spray nozzle 27 and configured such that they are substantially parallel to the plane of rotation of the internal spray nozzle 27 but are angled slightly with respect to the plane which is perpendicular to the plane of rotation such that a pressurized water stream flowing through the spray jets 29 will cause the internal spray nozzle 27 to rotate about the axis of the internal spray nozzle 27. The spray jets 29 may be configured to spray in a flat fan pattern, conical pattern, or rotating pattern with a spread between fifteen and forty degrees or a directed stream pattern. The water input 26, internal spray nozzle 27 and spray jets 29 may be constructed of any rigid material with preference to metal construction. The water input 26 and the internal spray nozzle 27 may have a circular, elliptical or polygonal cross section, but are preferably circular in cross section.

Referring to the drawings, FIG. 1 depicts the outer shell 10 and the cleaning assembly assembled as a complete unit which constitutes the pipe thread cleaner 100. To assemble the pipe thread cleaner, the end plate 22 of the cleaning assembly 20 is inserted into the first end of the shell 10 and put into the shell until the end plate mates with the inner flange 11 of the shell 10 and the bulkhead 21 mates with the outer flange 12 of the shell 10. There may be a gasket 13 situated between the bulkhead 21 and the outer flange 12 to provide additional sealing of the pipe thread cleaner. Once the cleaning assembly 20 is fully inserted into the shell 10, the attachment features are secured such that the Cleaning assembly 20 and the shell 10 are firmly affixed together.

Figure 3:
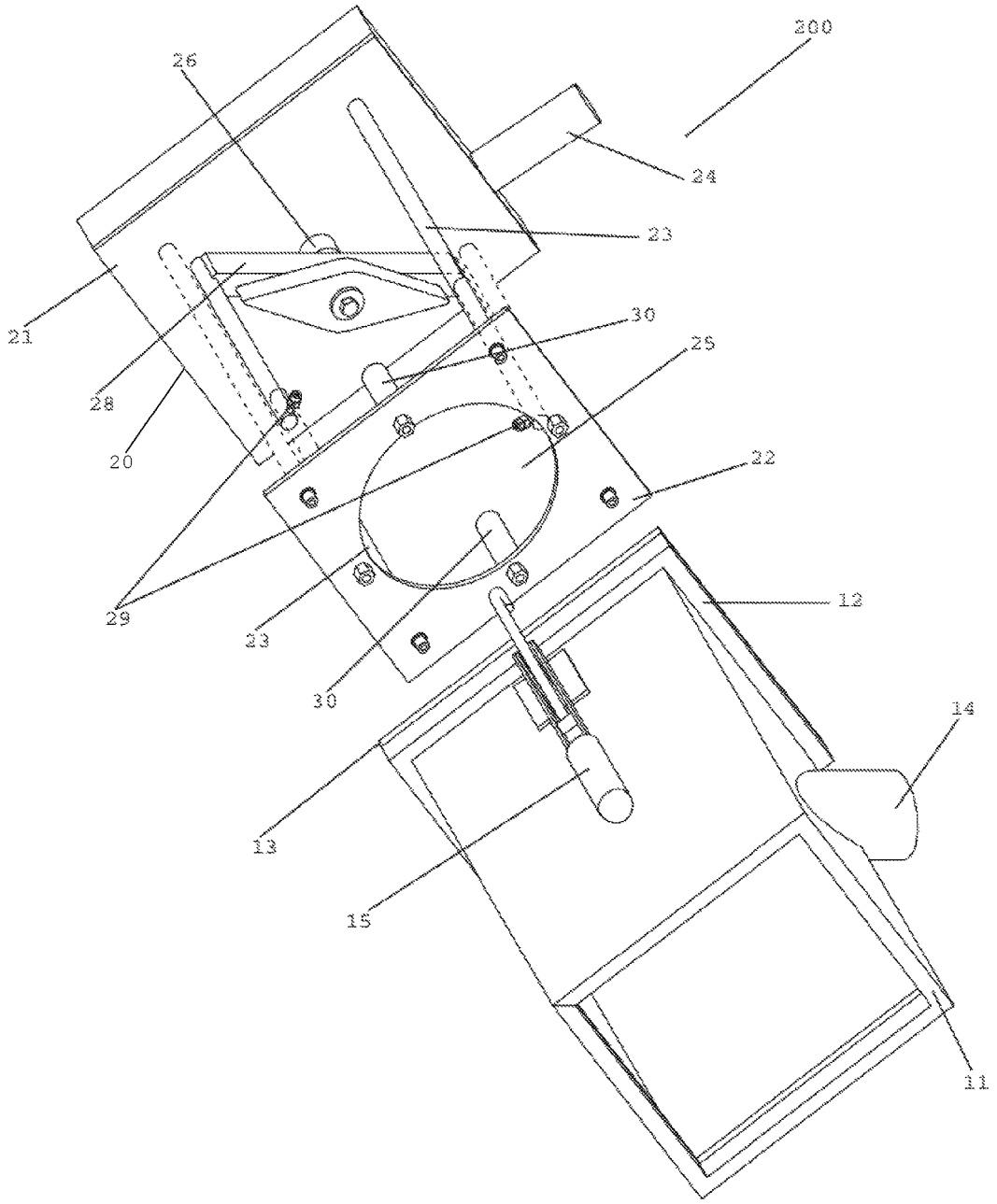
FIG. 3 s a perspective view of a second embodiment of a pipe thread cleaner of with the outer shell removed from the device.
Figure 5A:
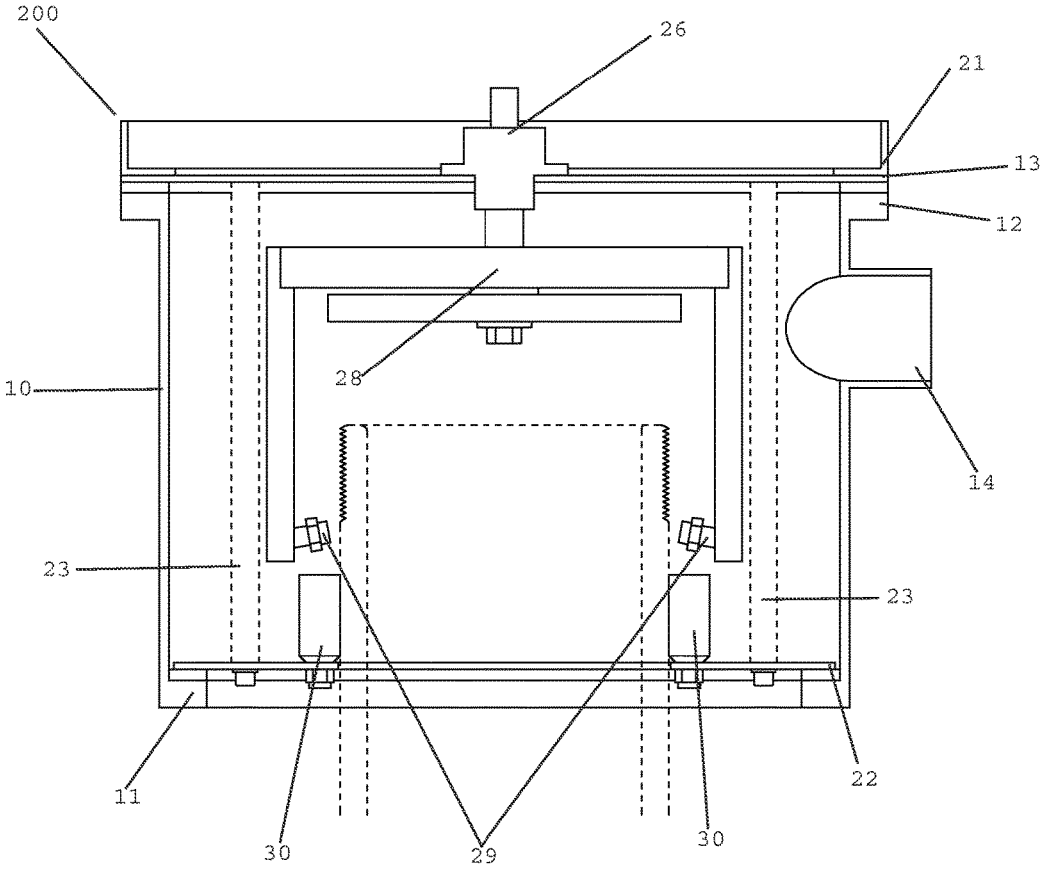
FIG. 5A is a cutaway view of a second embodiment of a pipe thread cleaner showing the placement of an inserted pipe.
Figure 5B:
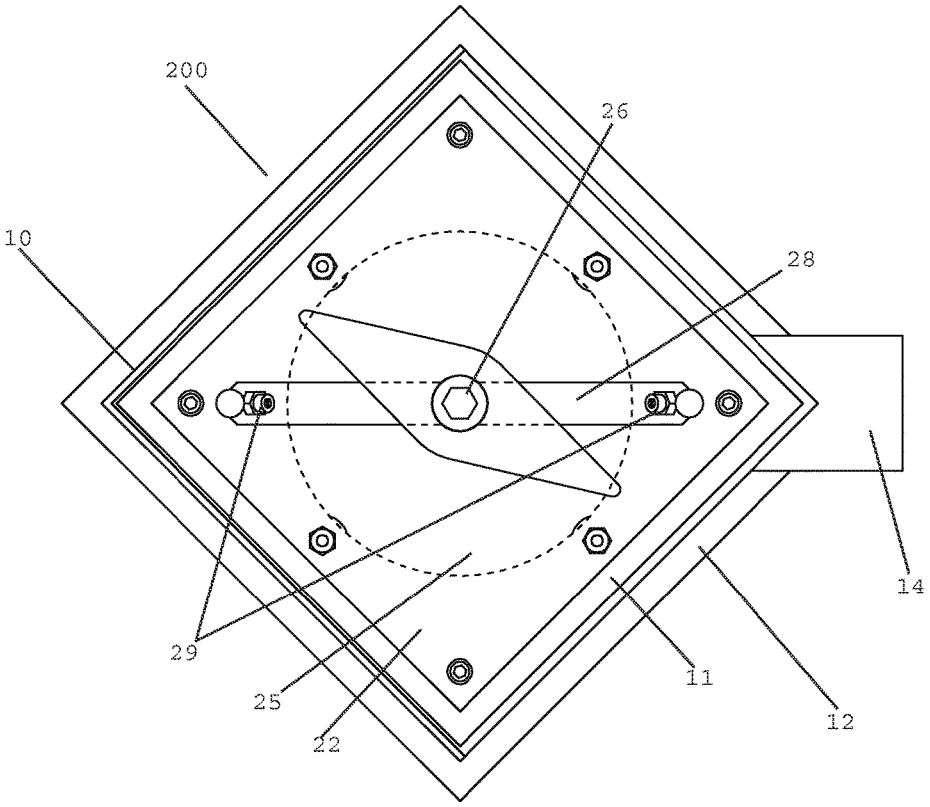
FIG. 5B is an end view of a first embodiment of a pipe thread cleaner.
Figure 6:
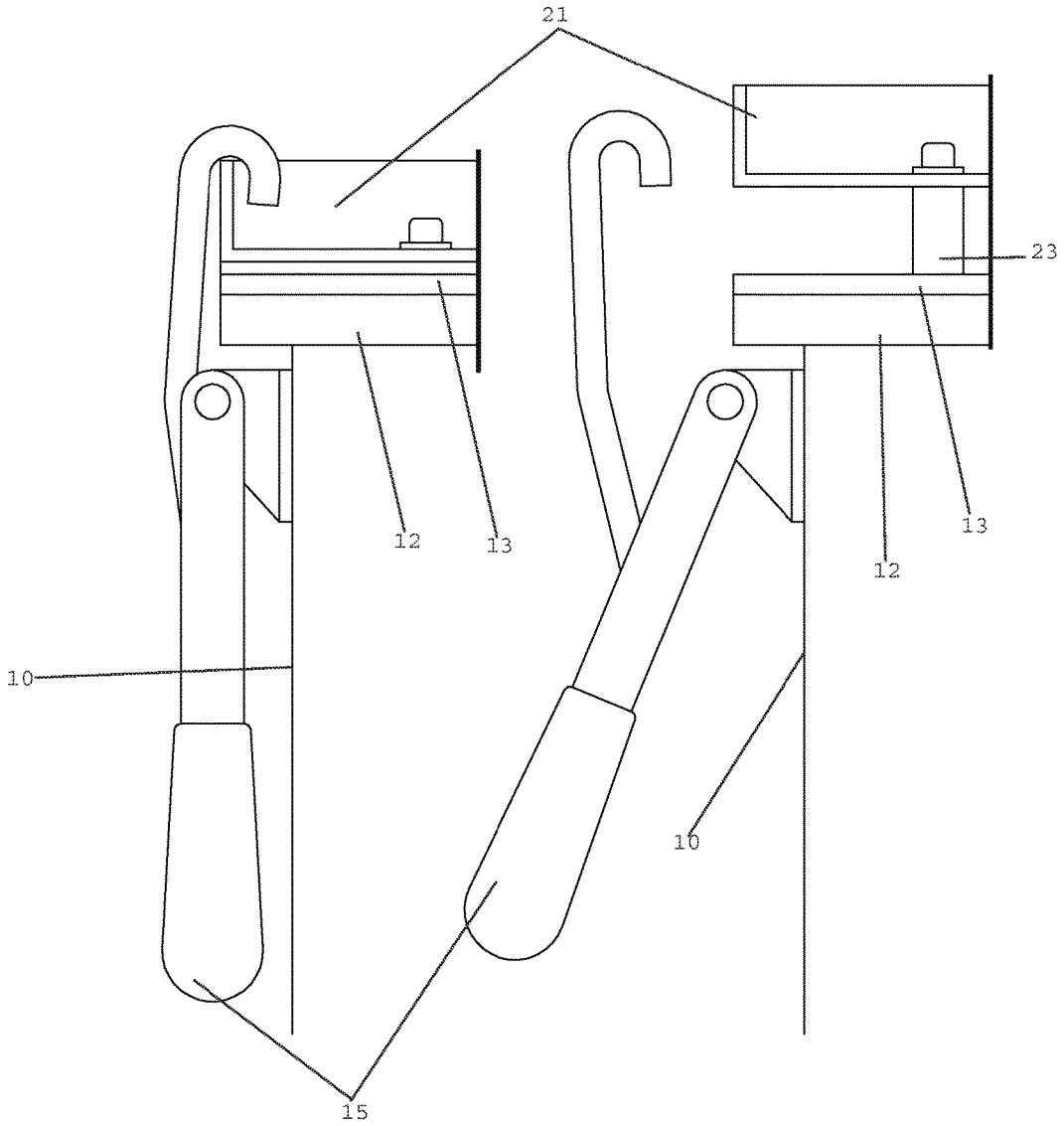
FIG. 6 is a detailed view of the latches of the present invention.

Referring further to the drawings, FIGS. 3, 5A, and 5B depict a second embodiment of the pipe thread cleaner 200. The second embodiment of the invention is identical to the first embodiment except that the second embodiment does not have an internal spray nozzle 27. The second embodiment has an external spray nozzle 28 attached to the water input 26.

Referring to the drawings, FIGS. 5A and 5B depict the water input 26, external spray nozzle 28, and spray jets 29. Attached to the water input is an external spray nozzle 28. The external spray nozzle 28 is configured to provide a plurality of spray jets 29 which spray water in a direction radially inward toward the axis of the external spray nozzle 28. The preferred configuration of the external spray nozzle 28 is a squared U configuration with two spray jets 29 oriented 180 degrees from one another. The spray jets 29 are attached to the ends of the external spray nozzle 28 and configured such that they are substantially parallel to the plane of rotation of the external spray nozzle 28 but are angled slightly with respect to the plane which is perpendicular to the plane of rotation such that a pressurized water stream flowing through the spray jets 29 will cause the external spray nozzle 28 to rotate about the axis of the external spray nozzle 28. The spray jets 29 may be configured to spray in a flat fan pattern, conical pattern, or rotating pattern with a spread between fifteen and forty degrees or a directed stream pattern. The water input 26, external spray nozzle 28 and spray jets 29 may be constructed of any rigid material with preference to metal construction. The water input 26 and the external spray nozzle 28 may have a circular, elliptical or polygonal cross section, but are preferably circular in cross section To operate the first embodiment of the pipe thread cleaner 100 of the second embodiment of the pipe thread cleaner 200, the outer shell 10 and cleaning assembly 20 should be assembled as described herein above. Once the pipe thread cleaner 100 is assembled, meaning the outer shell 10 and cleaning assembly 20 are attached to one another, a pressurized water source is attached to the water input 26 via commonly available plumbing components. The pressurized water source is defined as any water source or pressure booster which provides over 100 PSI of water pressure and may be a commonly available pressure washer which is powered by electricity or an internal combustion engine. The pressurized water source may further provide a valve by which the operator may control the input of water into the water input.

Referring to the drawings, FIG. 4A depicts operation of the first embodiment of the invention 100. A pipe with internal threads is inserted into the pipe input port 25 to such a depth that the internal spray nozzle 27 is proximate to the pipe threads to be cleaned. The pipe thread cleaner is then oriented such that the drain port 14 is on the low side of the shell 10 so that water will drain out by gravity. The operator may attach a hose or container to the drain port 11 to contain and used water from the operation of the pipe thread cleaner 100. Once the pipe is inserted, the user applies the pressurized water to the water input 26 such that the water is expelled through the rotating internal spray 27 and the entirety of the inserted section of pipe is cleaned. When the operation of the first embodiment 100 is complete, the first embodiment of the pipe thread cleaner 100 may be disassembled for cleaning by releasing the attachment features 15 and removing the cleaning assembly 20 from the shell 10. As the end plate 22 is dimensioned only slightly smaller than the internal dimensions of the shell 10, the end plate 22, as the cleaning assembly is removed, acts to scrape any built up matter from the inside of the shell 10. Once disassembled, the shell 10 and cleaning assembly may be cleaned by conventional means.

Referring to the drawings, FIG. 5A depicts operation of the second embodiment of the invention 200. A pipe with external threads is inserted into the pipe input port 25 to such a depth that the external spray nozzle 28 is proximate to the pipe threads to be cleaned. The pipe thread cleaner is then oriented such that the drain port 14 is on the low side of the shell 10 so that water will drain out by gravity. The operator may attach a hose or container to the drain port 11 to contain and used water from the operation of the pipe thread cleaner 100. Once the pipe is inserted, the user applies the pressurized water to the water input 26 such that the water is expelled through the rotating external spray 28 and the entirety of the inserted section of pipe is cleaned. When the operation of the second embodiment 200 is complete, the second embodiment of the pipe thread cleaner 200 may be disassembled for cleaning by releasing the attachment features 15 and removing the cleaning assembly 20 from the shell 10. As the end plate 22 is dimensioned only slightly smaller than the internal dimensions of the shell 10, the end plate 22, as the cleaning assembly is removed, acts to scrape any built up matter from the inside of the shell 10. Once disassembled, the shell 10 and cleaning assembly may be cleaned by conventional means.

While this invention has been described with the specific embodiments outlines above, the preferred embodiments set forth are intended to be illustrative, not limiting. Various changes may be made without departing from the scope of the invention as defined in the following claims. The claims provide the scope of coverage of this invention and should not be limited to the specific examples cited above.

What is claimed is:

1. A pipe thread cleaner configured to clean internally threaded pipe comprising:

an outer shell having a first end and a second end, and having an inner flange located at the first end and an outer flange located at the second end, a drain port and attachment features; and a cleaning assembly configured to be inserted into and attached to the outer shell having:

a bulkhead configured to mate with the outer flange, an end plate configured to mate with the inner flange having a pipe input port, support rods configured to attach the bulkhead to the end plate, a water input attached to the bulkhead configured to attach to an external pressurized water source, an internal spray nozzle connected to the water input having water jets and configured to rotatably spray a pressurized stream of water in a radially outward direction when the external pressurized water source is applied via the water input.

2. A pipe thread cleaner according to claim 1 further comprising a handle affixed to the bulkhead.

3. A pipe thread cleaner according to claim 1 further comprising a gasket configured to seal the bulkhead and the outer flange.

4. A pipe thread cleaner according to claim 1 where the cleaning assembly further has multiple guide posts attached to the end plate.

5. A pipe thread cleaner according to claim 1 wherein the outer shell is metal.

6. A pipe thread cleaner according to claim 1 wherein the cleaning assembly is metal.

7. A pipe thread cleaner according to claim 1 wherein the outer shell is rigid plastic.

8. A pipe thread cleaner according to claim 1 wherein the cleaning assembly is rigid plastic.

9. A pipe thread cleaner configured to clean externally threaded pipe comprising:

an outer shell having a first end and a second end, and having an inner flange located at the first end and an outer flange located at the second end, a drain port and attachment features; and a cleaning assembly configured to be inserted into and attached to the outer shell having:

a bulkhead configured to mate with the outer flange, an end plate configured to mate with the inner flange having a pipe input port, support rods configured to attach the bulkhead to the end plate, a water input attached to the bulkhead configured to attach to an external pressurized water source, an external spray nozzle connected to the water input having water jets and configured to rotatably spray a pressurized stream of water in a radially inward direction when the external pressurized water source is applied via the water input.

10. A pipe thread cleaner according to claim 9 further comprising a handle affixed to the bulkhead.

11. A pipe thread cleaner according to claim 9 further comprising a gasket configured to seal the bulkhead and the outer flange.

12. A pipe thread cleaner according to claim 9 the cleaning assembly further has multiple guide posts attached to the end plate.

13. A pipe thread cleaner according to claim 9 wherein the outer shell is metal.

14. A pipe thread cleaner according to claim 9 wherein the cleaning assembly is metal.

15. A pipe thread cleaner according to claim 9 wherein the outer shell is rigid plastic.

16. A pipe thread cleaner according to claim 9 wherein the cleaning assembly is rigid plastic.

17. A pipe thread cleaner configured to clean threaded pipe comprising:

an outer shell having a first end and a second end, and having an inner flange located at the first end and an outer flange located at the second end, a drain port and attachment features; and a cleaning assembly configured to be inserted into and attached to the outer shell having:

a bulkhead configured to mate with the outer flange, an end plate configured to mate with the inner flange having a pipe input port, support rods configured to attach the bulkhead to the end plate, a water input attached to the bulkhead configured to attach to an external pressurized water source, a spray nozzle connected to the water input having water jets and configured to rotatably spray a pressurized stream of water in a radial direction when the external pressurized water source is applied via the water input.

* * * * *